United States Patent [19]

Krettek et al.

[11] Patent Number: 5,066,271

[45] Date of Patent: Nov. 19, 1991

[54] BLADE-SUPPORT SYSTEM FOR CENTRIFUGE

[75] Inventors: Guntram Krettek, Viersen; Wilhelm Schmitz, Schwalmtal, both of Fed. Rep. of Germany

[73] Assignee: Krupp Industrietechnik GmbH, Duisburg, Fed. Rep. of Germany

[21] Appl. No.: 479,711

[22] Filed: Feb. 14, 1990

[30] Foreign Application Priority Data

Feb. 14, 1989 [DE] Fed. Rep. of Germany ..... 3904358

[51] Int. Cl.[5] ..... B04B 11/08

[52] U.S. Cl. ..... 494/58; 494/60

[58] Field of Search ..... 494/56, 57, 58, 60

[56] References Cited

U.S. PATENT DOCUMENTS

| | | | |
|---|---|---|---|
| 2,755,991 | 7/1956 | Tholl et al. | 494/60 X |
| 3,279,612 | 10/1966 | O'Conor | 494/58 X |
| 3,279,613 | 10/1966 | Daubman, Jr. et al. | 494/58 X |
| 3,779,450 | 12/1973 | Shapiro | 494/57 X |
| 4,652,254 | 3/1987 | Matsumoto | 494/58 |

FOREIGN PATENT DOCUMENTS 1432886 6/1971 Fed. Rep. of Germany .

*Primary Examiner*—Daniel M. Yasich

*Attorney, Agent, or Firm*—Herbert Dubno; Andrew Wilford

[57] ABSTRACT

A centrifuge has a generlly stationary and closed housing, a drum rotatable in the housing about a drum axis and having an end wall and an outer drum wall, a blade extending generally axially in the housing generally parallel to the drum wall, and a blade holder having an inner end carrying the blade and an outer end projecting through the housing end wall out of the housing. Seals snugly engaged between the outer end and the housing hermetically seal the housing around the holder and a guide fixed on the end wall supports the outer holder end on the housing for sliding movement of the holder and blade on the housing in an adjustment direction generally radial of the drum axis. An actuator engaged between the housing and the outer holder end displaces the holder and blade in the adjustment direction relative to the housing.

18 Claims, 5 Drawing Sheets

BLADE-SUPPORT SYSTEM FOR CENTRIFUGE

FIELD OF THE INVENTION

The present invention relates to a basket centrifuge More particularly this invention concerns a stripper-blade system for a centrifuge.

BACKGROUND OF THE INVENTION

A standard centrifuge for separating a slurry into solid and liquid fractions has a foraminous drum that is rotated at high speed about its axis. The slurry is fed into the drum so that the liquid fraction is driven centrifugally out, leaving a cake of the solid fraction adhering to the inner surface of the drum. The operation typically takes place in a wholly closed chamber so that a pressure differential can be applied to maximize the separation effect and to aspirate as much as possible of the liquid phase.

It is standard to strip out the solid fraction by means of a blade which is positioned inside the drum to skim off the inner surface of the normally cylindrically tubular mass of the solid-phase cake resting on the inner face of the separation drum. This blade normally has an outer edge extending parallel to the axis and is pointed against the rotation direction of the drum.

In order to control the stripping operation the blade is mounted as described in U.S. Pat. No. 3,779,450 so that it can be radially displaced in the drum. To this end the blade is carried on the outer end of generally radially extending arms whose inner ends are fixed on a shaft extending parallel to but offset from the drum axis and projecting out of the housing through a seal arrangement. Pivoting of this shaft about its own axis therefore angularly displaces the blade edge arcuately so that some control over the radial spacing of the blade edge from the inside housing surface is obtained. Unfortunately such control is fairly crude, as the movement arc of the blade is normally set to just tangent the inner drum surface. As a result there is a compound trigonometric relationship between the angular position of the blade shaft and the radial spacing between the blade and the drum.

In another known system described in German patent document 1,432,886 filed 03 March 1984 by H. J. Titus a basically pivotal blade can be swept parallel to the drum axis along the drum inner surface to strip off the filter cake thereon. This arrangement still has the essentially pivotal system that makes accurately positioning the blade very difficult. In this arrangement, once again, the continuously changing angle of attack of the blade as it is adjusted makes the stripping force different and generally causes the parameters of the stripping action to change.

OBJECTS OF THE INVENTION

It is therefore an object of the present invention to provide an improved centrifuge Another object is the provision of such an improved centrifuge which overcomes the above-given disadvantages, that is whose blade can be accurately and easily adjusted and wherein stripping parameters and blade attack angle change insignificantly as the blade position in the drum is adjusted.

SUMMARY OF THE INVENTION

A centrifuge according to the invention has a generally stationary and closed housing, a drum rotatable in the housing about a drum axis and having an end wall and an outer drum wall, a blade extending generally axially in the housing generally parallel to the drum wall, and a blade support or holder having an inner end carrying the blade and an outer end projecting through the housing end wall out of the housing. Seals snugly engaged between the outer end and the housing hermetically seal the housing around the holder and a guide fixed on the end wall supports the outer holder end on the housing for sliding movement of the holder and blade on the housing in an adjustment direction generally radial of the drum axis. An actuator engaged between the housing and the outer holder end displaces the holder and blade in the adjustment direction relative to the housing.

With the system of this invention it is possible to maintain a perfect gastight seal where the holder projects through the housing wall. At the same time setting a desired radial spacing between the blade edge and inner drum wall is extremely simple, and a change in this spacing is not associated with any change in blade angle at all.

According to a further feature of this invention the holder includes a generally axially extending beam projecting axially through the housing end wall and a generally radially extending shaft fixed to the beam. The housing includes an actuator housing itself including an upper part formed as the guide slidably receiving the shaft and a lower part provided with glides engaged between the outer end and the holder and forming part of the guide. The actuator housing has a flange joining its two parts and is provided at the flange with an annular seal surrounding the shaft and the lower housing part is U-shaped and projects through the housing end wall. The housing end wall is provided with an openable door formed with an opening through which the lower housing part projects The glides according to this invention are set in the beam and slide on the lower housing part. Furthermore two of the glides are on opposite faces of the beam. The beam itself has an axially directed end face provided with one of the glides and the glides are made of polytetrafluoroethylene. This construction makes it very easy to ensure perfect straight-line guiding of the blade while still holding it solidly against the tangential forces effective on it as the cake is skimmed off.

In accordance with further features of the invention the shaft has a lower end set in the beam and an upper end provided with a collar connected to the actuator. In addition the actuator has an upper end pivoted on the collar and a lower end pivoted on the housing. The lower housing part is formed with a downwardly open port aligned with the shaft and is provided with a cover closing the port hermetically and the holder includes a sheet-metal casing fixed to the beam and carrying the blade. This casing has a pair of axially spaced end walls and a pair of generally axially extending and angularly spaced side walls bridging the end walls and forming a passage therewith. The blade itself is carried on a side wall having an edge provided with a blade seat in which the blade is carried.

The centrifuge according to this invention is provided with a jacket secured to the housing end wall and enclosing the actuator housing and actuator. In addition a stop fixed in the housing is engageable with the holder for limiting travel of the blade axially outward beyond a predetermined position. This stop projects through the housing and is provided with a seal hermetically sealing between itself and the housing.

DESCRIPTION OF THE DRAWING

The above and other objects, features, and advantages will become more readily apparent from the following, reference being made to the accompanying drawing in which.

SPECIFIC DESCRIPTION

Figure 1:
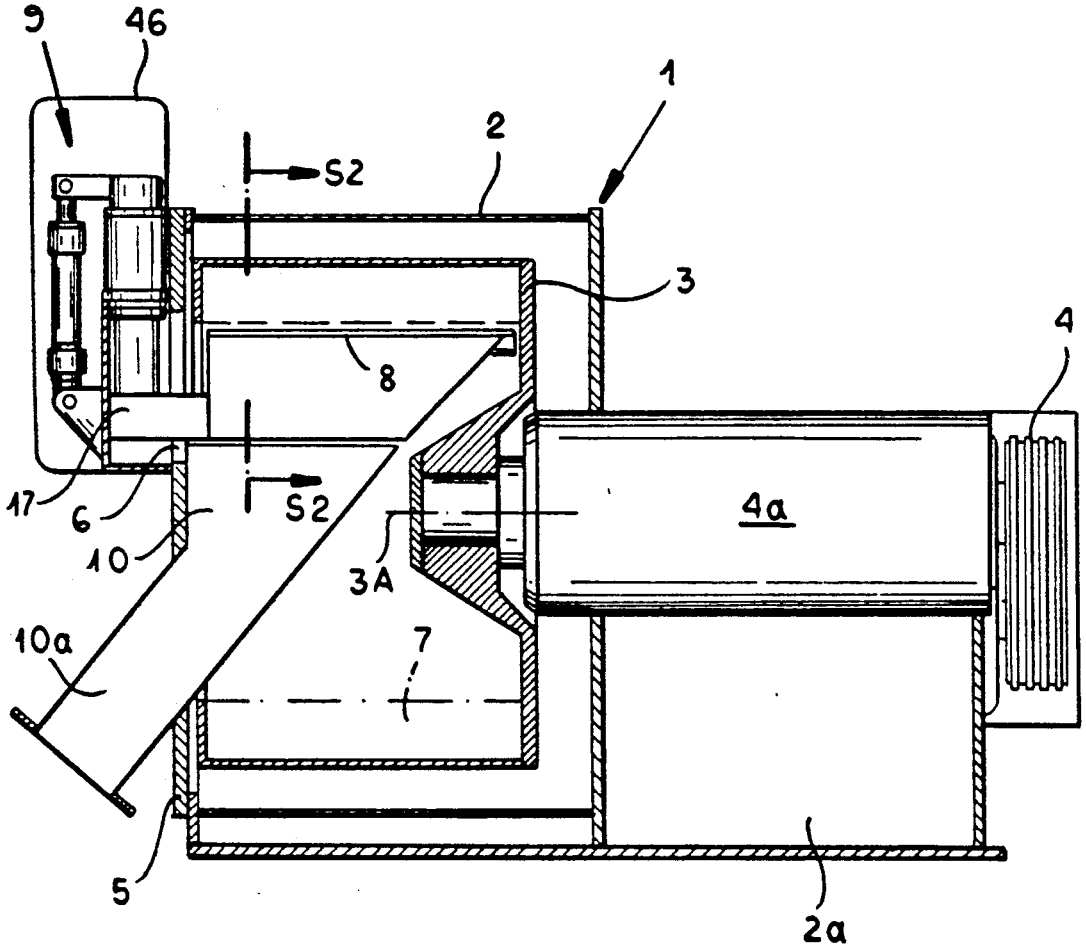
FIG. 1 is a small-scale and partly diagrammatic vertical section through the apparatus according to this invention.
Figure 2:
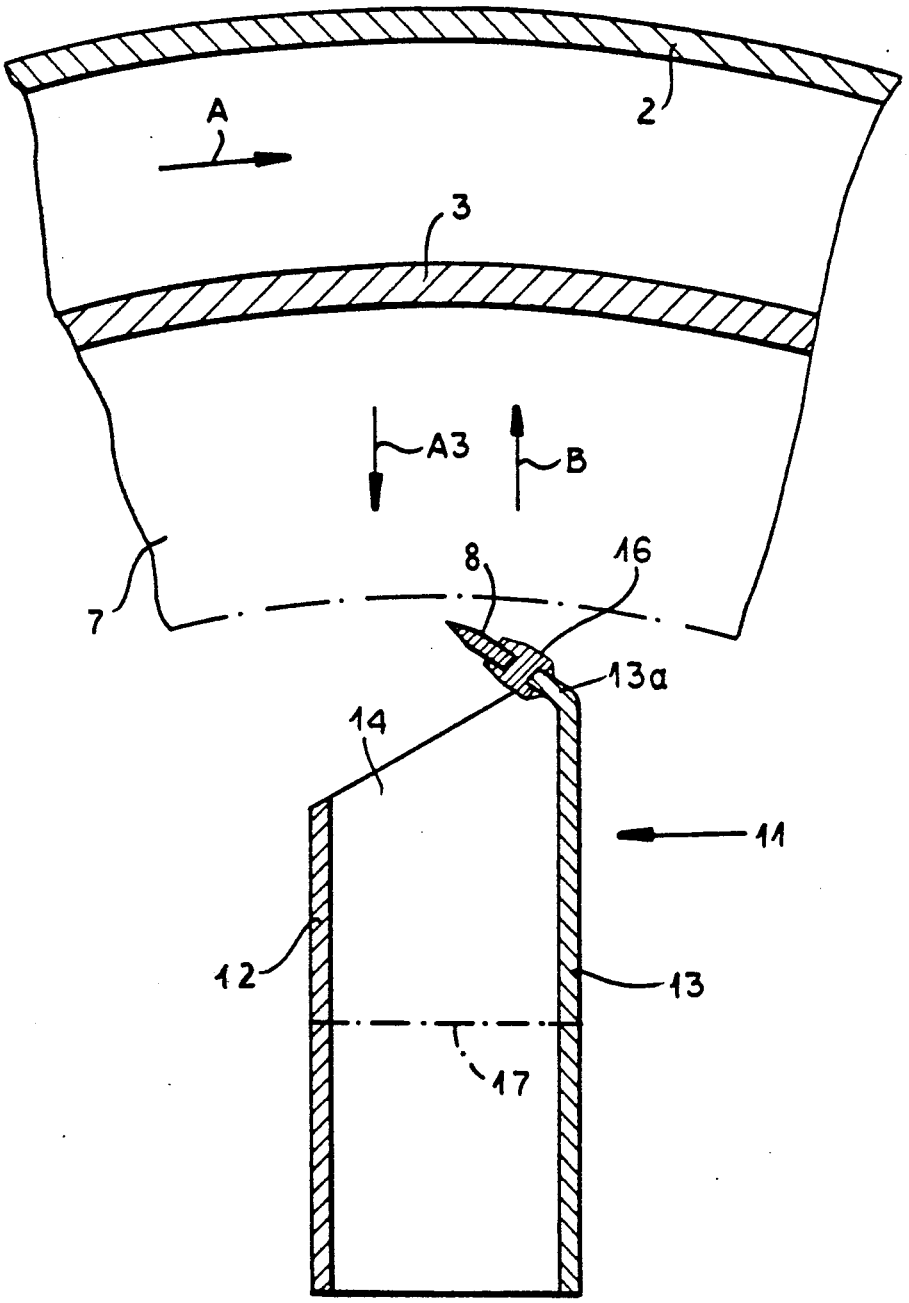
FIG. 2 is a large-scale section taken along line S2—S2 of FIG. 1.

As seen in FIG. 1 a centrifuge 1 according to this invention has a substantially closed housing 2 in which a foraminous drum 3 is supported in a journal 4*a* for rotation about a drum axis 3A in the direction indicated by arrow A in FIG. 2. The housing 2 has a base 2*a* supporting a drive 4 that rotates the drum 3 at high speed about the axis 3A and has a front end wall normally closed by a door 5. Unillustrated means feeds a slurry to be separated to the interior of the drum 3 so that a solids cake 7 forms on the inner surface of the drum 3.

Figure 4:
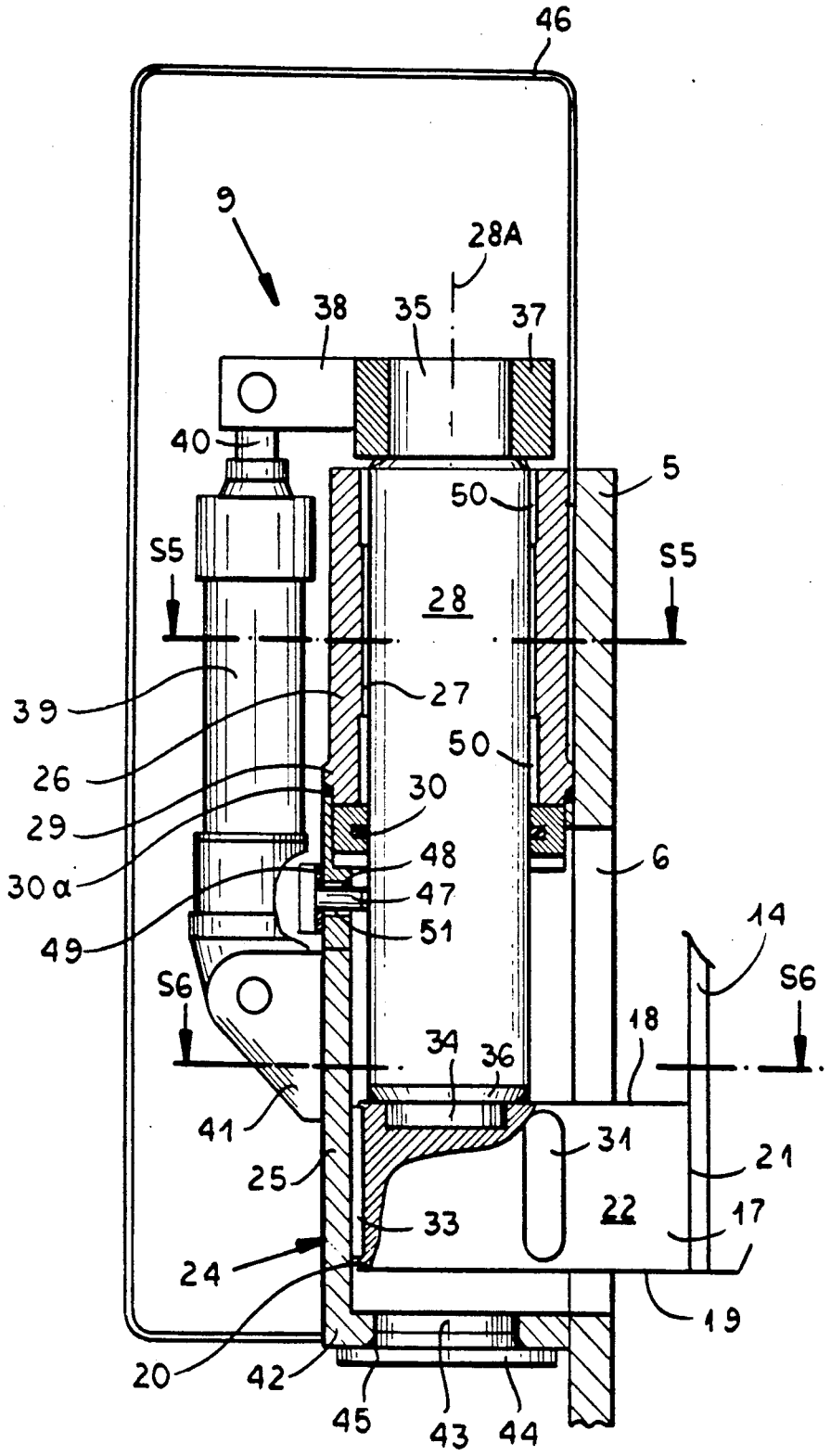
FIG. 4 is a large-scale view of a detail of FIG. 1.
Figure 5:
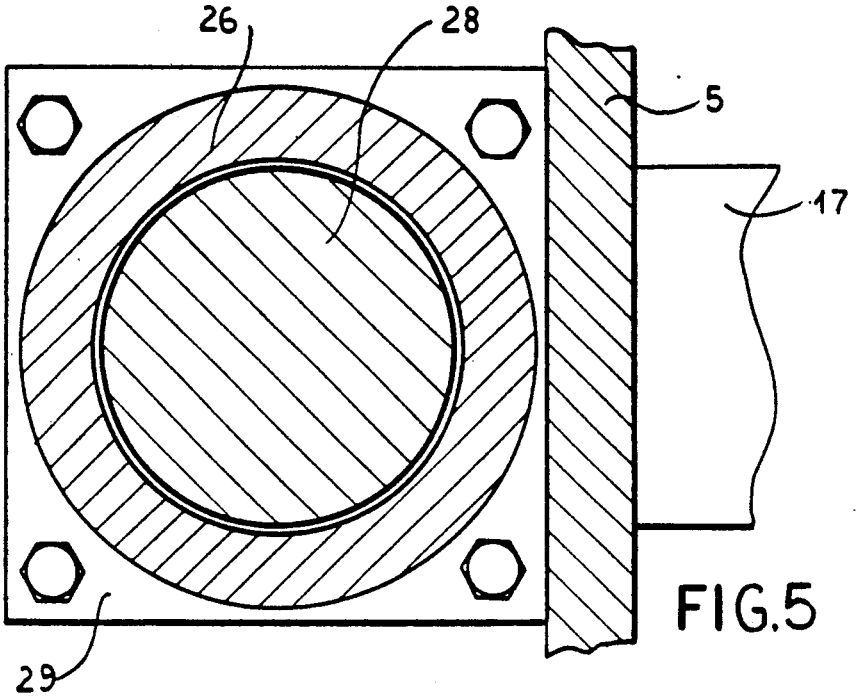
FIGS. 5 and 6 are sections taken respectively along lines S5—S5 and S6—S6 of FIG. 4.
Figure 6:
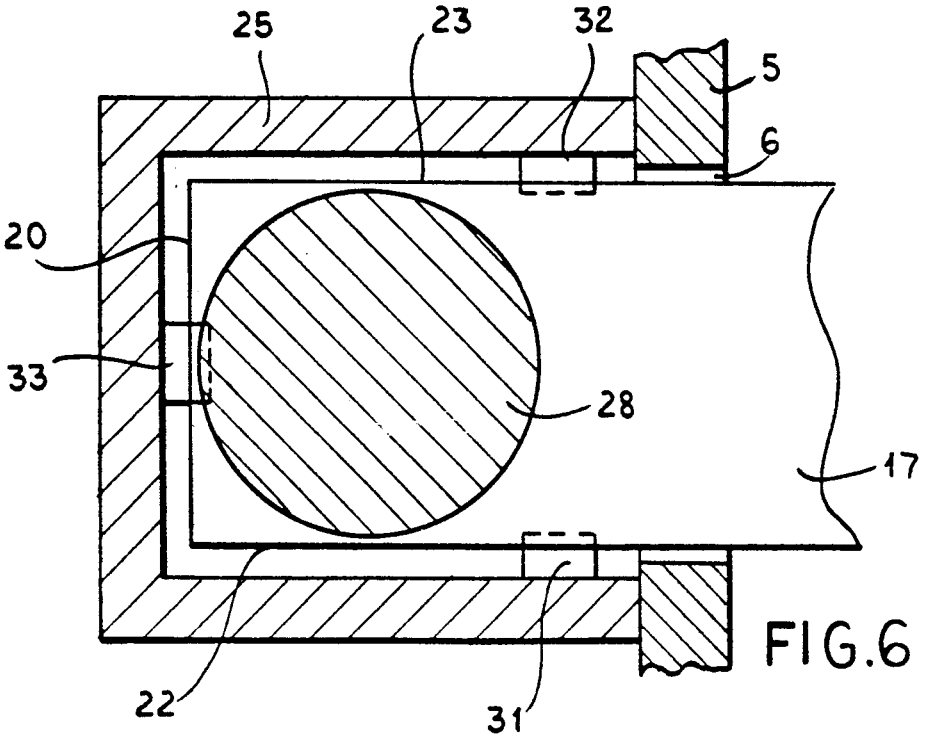

According to this invention as shown in FIG. 2 a skimming blade 8 extending parallel to the axis 3A is supported on a box-like holder 11 carried on the inside end of a support beam 17 projecting through an opening slot 6 (FIGS. 1 and 4) in the door 5. Underneath the blade 8 is a catch funnel 10 leading to an outlet chute or conduit 10*a* so that solids scraped off the cake 7 by the blade 8 can be conducted out of the housing 2 An actuator assembly 9 can displace this blade 8 with its holder 11 and beam 17 radially of the axis A as indicated by arrow B in FIG. 2.

Figure 3:
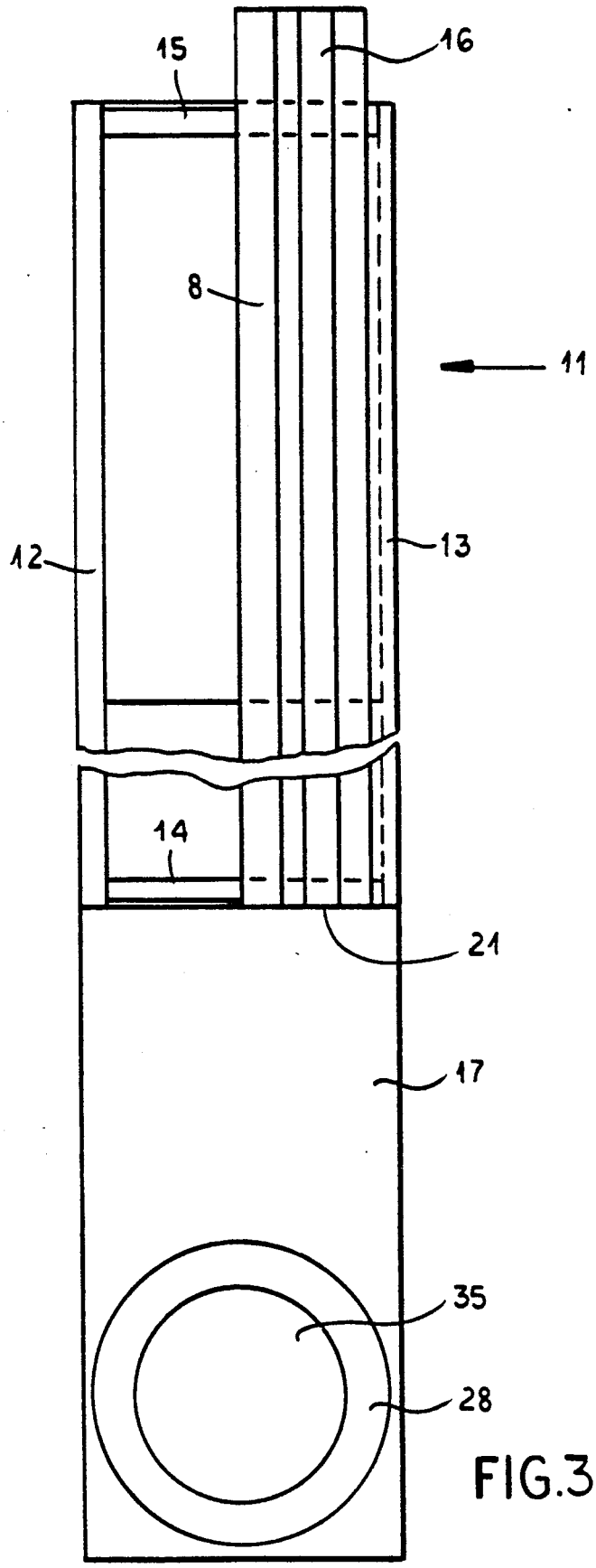
FIG. 3 is a top detail view taken in the direction of arrow A3 of FIG. 2.

As seen also in FIG. 3 the holder 11 has, relative to the rotation direction B, a front wall 12 and a back wall 13 both extending parallel to each other and to a radius of the axis 3A, and end walls 14 and 15 also extending parallel to each other but perpendicular to the axis 3A. These walls 12 through 15 together form a sheet metal casing that is very rigid structure fixed to the inner end of the beam 17. The rear wall 13 has a forwardly bent outer edge 13*a* which is fitted with an H-section blade mount 16 into which the blade 8 is fitted. The outer edge of the front wall 12 is radially inside the blade 8 so that material skimmed from the cake 7 by the blade 8 is dumped into the passage formed by the holder 11 and thence conducted out of the centrifuge 1 through the outlet 10*a*.

The support beam 17 which is a massive metal structure of rectangularly parallepipedal shape is attached to the axial outer end of the holder box 11 and has as shown in FIGS. 3 through 6 radial inner and outer or top and bottom surfaces 18 and 19, axial inner and outer end faces 20 and 21, and front and rear side faces 22 and 23.

An actuator guide housing 24 fixed to the outside face of the door 5 is comprised of a U-section lower part 25 and a cylindrically tubular upper part 26 joined together at a flange 29. A cylindrical shaft 28 is slidable along an axis 28A extending radially of the axis 3A and rides on low-friction bushings 50 in a bore 27 formed in the upper part 26. Seals 30 and 30*a* are provided between the housing parts 25 and 26 and between the housing 24 and the shaft 28. The outer end of the beam 17 is provided with glide pads 31 and 32 on its faces 22 and 23 and with another such pad 33 on its end face 20 that glide on the complementary inner faces of the lower guide part 25 to insure smooth sliding of the beam 17 in the guide 24. These pads are set into the beam 17 and are made of a low friction material such as polytetrafluoroethylene (Teflon TM). The lower housing part 25 has a lower wall 42 formed with a port 43 closed by a cover 44 provided with a seal 45 to allow the interior of the housing 2 to be maintained under subatmospheric pressure.

The shaft 28 has a lower end formed with a small-diameter pin extension 36 fixed in a complementary recess 34 formed in the top face 18 of the beam 17 and an upper end formed with a similar pin extension 35 received in a collar 37. A radially projecting tab 38 from this collar 37 is pivoted to a piston rod 40 of an actuator 39 itself pivoted on a flange 41 fixed on the lower housing part 25. This actuator 39 is a hydraulic cylinder which here is mounted outside the outer end face 20 of the beam 17, although it could equally well be mounted adjacent either side face 22 or 23 Expansion and contraction of the actuator 39 will radially displace the blade 8 in the direction B (FIG. 2). A synthetic-resin casing or jacket 46 protects the actuator 30 and associated parts.

In order to limit the radial outward travel of the blade 8, the lower housing part 25 is fitted with a stop pin 47 that can engage the upper face 18 of the beam 17. Seals 48 and 49 prevent leakage at the port 51 formed in the part 25 for this stop 47. This stop 47 prevents damage to the drum 3 on failure of the unillustrated end-position switch that normally shuts off fluid feed to the actuator 39 when the innermost safe position is reached.

I claim:

1. A centrifuge comprising:

a generally stationary and closed drum housing having a housing end wall;

a drum rotatable in the drum housing about a drum axis and having an outer drum wall extending generally along the axis;

a blade extending generally axially in the drum housing generally parallel to the outer drum wall;

a blade support having a generally axially extending beam projecting axially through the housing end wall and carrying the blade and a generally radially extending shaft outside the drum housing and fixed to the beam;

an actuator housing fixed on the drum housing and including an upper part slidably receiving the shaft and a lower part supporting the shaft on the drum housing for sliding movement of the support and blade on the drum housing in an adjustment direction generally radial of the drum axis;

glide pads between the actuator housing and the blade support;

at least one seal snugly engaged between the blade support and the actuator housing and hermetically sealing the actuator housing around the blade support; and an actuator engaged between the actuator housing and the shaft for displacing the support and blade in the adjustment direction relative to the drum housing.

2. The centrifuge defined in claim 1, further comprising a jacket secured to the housing end wall and enclosing the actuator housing and actuator.

3. The centrifuge defined in claim 1 wherein the actuator housing has a flange joining the upper part with the lower part and one of the seals is provided at the flange surrounding the shaft.

4. The centrifuge defined in claim 3 wherein the lower housing part is U-shaped and is fixed to the housing end wall.

5. The centrifuge defined in claim 4 wherein the housing end wall is provided with an openable door formed with an opening through which the beam projects.

6. The centrifuge defined in claim 1 wherein the glide pads are set in the beam and slide on the lower housing part.

7. The centrifuge defined in claim 6 wherein two of the glide pads are on opposite faces of the beam.

8. The centrifuge defined in claim 6 wherein the beam has an axially directed end face provided with one of the glide pads.

9. The centrifuge defined in claim 6 wherein the glide pads are made of polytetrafluoroethylene.

10. The centrifuge defined in claim 1 wherein the shaft has a lower end set in the beam and an upper end provided with a collar connected to the actuator.

11. The centrifuge defined in claim 10 wherein the actuator has an upper end pivoted on the collar and a lower end pivoted on the actuator housing.

12. The centrifuge defined in claim 1 wherein the lower actuator housing part is formed with a downwardly open port aligned with the shaft and is provided with a cover closing the port hermetically.

13. The centrifuge defined in claim 1 wherein the support includes a sheet-metal casing fixed to the beam and carrying the blade.

14. The centrifuge defined in claim 13 wherein the casing has a pair of axially spaced end walls and a pair of generally axially extending and angularly spaced side walls bridging the casing end wall and forming a passage therewith.

15. The centrifuge defined in claim 14 wherein the blade is carried on one of the side walls of the casing.

16. The centrifuge defined in claim 15 wherein the one of the side walls of the casing has an edge provided with a blade seat in which the blade is carried.

17. The centrifuge defined in claim 1, further comprising means including a stop fixed in the actuator housing and engageable with the support for limiting travel of the blade axially outward beyond a predetermined position.

18. The centrifuge defined in claim 17 wherein the stop projects through the actuator housing and is provided with a seal hermetically sealing between itself and the actuator housing.

* * * * *